US005868266A

United States Patent [19]

Nobakht

[11] Patent Number: 5,868,266

[45] Date of Patent: Feb. 9, 1999

[54] CONTAINER HAVING AN ADJUSTABLE INNER BASE WALL

[76] Inventor: Jamshid Nobakht, 6800 Macdonald Ave., #110, Cote St-Luc, Quebec, Canada, H3X 3Z2

[21] Appl. No.: 916,537

[22] Filed: Aug. 22, 1997

[51] Int. Cl.[6] ..... B65D 25/38

[52] U.S. Cl. ..... 220/23.86; 220/23.83; 220/23.9; 220/735; 220/501; 206/804

[58] Field of Search ..... 206/804; 220/23.83, 220/735, 23.86, 23.9, 501, 527, 530

[56] References Cited

U.S. PATENT DOCUMENTS

| | | | |
|---|---|---|---|
| 1,566,860 | 12/1925 | Hainzigianis | 206/804 |
| 2,252,381 | 8/1941 | Ladd | 206/804 |
| 3,380,592 | 4/1968 | Arnold . | |
| 3,432,027 | 3/1969 | Mueller | 206/804 |
| 4,432,451 | 2/1984 | Hooser | 206/804 |
| 5,364,569 | 11/1994 | DeCoster . | |

FOREIGN PATENT DOCUMENTS

| | | | |
|---|---|---|---|
| 2 243 819 | 11/1991 | United Kingdom | 206/804 |

*Primary Examiner*—Stephen Castellano
*Attorney, Agent, or Firm*—Swabey Ogilvy Renault; Guy J. Houle

[57] ABSTRACT

A container 10 comprising a circumferential sidewall 12 having an integral base wall 14 for support of the container. The container 10 has an open top end 7 closeable by a lid 34. An article support base 24 is displaceable in the container in a guided manner and is provided with a biasing structure 38, 40 which urges it in an upward direction towards the open top end 7 to expose one or more objects 8 placed on the support base 24 and immersed in a liquid 9 which is placed within the container. The support base 24 has a projection 32 which is engageable by the lid 34 to maintain the support base 27 into the liquid 9. Passages 6 permit liquid to be displaced from opposed top and bottom ends of the support base 24. The biasing structure 38, 40 in one embodiment is constituted by a floatation casing 38 and in a further embodiment is constituted by a spring member 40.

11 Claims, 3 Drawing Sheets

CONTAINER HAVING AN ADJUSTABLE INNER BASE WALL

TECHNICAL FIELD

The present invention relates to a container having an immersible object(s) support base with biasing means to automatically elevate the support base in a liquid contained in the container to expose at least part of the object(s) above the liquid.

BACKGROUND ART

Numerous situations exit wherein it is desirable to retrieve solid objects submerged within a volume of liquid, the object and the liquid being both contained in an open-top container typically having a relatively small mouth aperture. One example of such situation exists in the field of food containers. Various types of foodstuff such as olives, pickles, marinated vegetables, condiments and the like are stored in open-top containers wherein they are submerged in a preserving liquid. One of the main drawbacks associated with this type of storage is that the foodstuff is difficult to retrieve from the container especially when it lies near the bottom of the latter. Scooping of the food from the container is at least partially hindered by the side walls of the container while pouring of the food usually results in the concomitant outflow of the preserving liquid, thus leading to messy spills.

Once the food is retrieved from the container it is usually transferred to a serving plate. When some of the food is unused, it is then placed back into the container. During each operation, there exists a risk of contaminating the food, splashing the liquid or spilling the latter. Furthermore, when such a situation occurs, it creates a need for an additional component namely the serving tray.

It is also desirable to store heavier articles, such as metal articles, in liquids, such as oil, and wherein the need arises to retrieve articles from time to time.

U.S. Pat. No. 5,634,569 shows a mechanical means of retracting articles contained in a liquid container. However, the articles cannot be freely arrested and exposed within a top part of the liquid container. One needs both hands to retract the articles, one to hold the support tray and the other to fetch the articles.

SUMMARY OF INVENTION

It is a feature of the present invention to provide a container having an object support base that is mounted inside the container and which is biased upwardly upon opening of the container lid, therefore automatically raising the object(s) towards the upper peripheral edge of the container while allowing the liquid to drip underneath the support base.

An advantage of the present invention is that the container allows a user to retrieve object(s) such as food submerged in a preserving liquid quickly and ergonomically without tilting the container or the use of a scooping action.

The container in accordance with the present invention allows the submerged object(s) to be skimmed out of the liquid and automatically raised to a position adjacent the upper peripheral edge of the container upon opening of the lid by an automatic and self-powered mechanism.

Another feature of the present invention is that the support base that is used to lift the object(s) can also act as a built-in serving tray when used in the context of food containers thus reducing the risks of contamination or spilling of the food.

A further feature is that the container in accordance with the present invention conforms to conventional methods of manufacturing and is thus relatively inexpensive to manufacture.

According to the above features, from a broad aspect, the present invention provides a container which comprises a circumferential sidewall having an integral base wall for support of the container on a surface. The container has an open top end with a peripheral top edge provided about the circumferential sidewall. An article support base is displaceable in the container. Guide means is provided for guiding the support base. Biasing means is provided for urging the support base in an upward direction towards the open top end to expose one or more objects placed on the support base and immersed in a liquid placed within the container. A lid is provided to close the open top end and to engage a projecting means connected to the support base to push and maintain the support base into the liquid when contained in the container. Passage means is provided for displacement of liquid from opposed top and bottom ends of the support base.

According to a still further broad aspect of the present invention there is provided a container which comprises a circumferential sidewall having an integral base wall for support of the container. The container has an open top end and a peripheral top edge is provided about the circumferential sidewall. An article support base is displaceable in the container. Guide means is provided for guiding the support base. Engagement means is provided for arresting the support base at a selected predetermined location upwardly towards the open top end to expose one or ore objects placed on the support base and immersed in a liquid placed within the container. A lid closes the open top end. Projecting means is connected to the support base to displace the support base into and out of the liquid when contained in the container. Passage means is provided for the displacement of liquid from opposed top and bottom ends of the support base.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
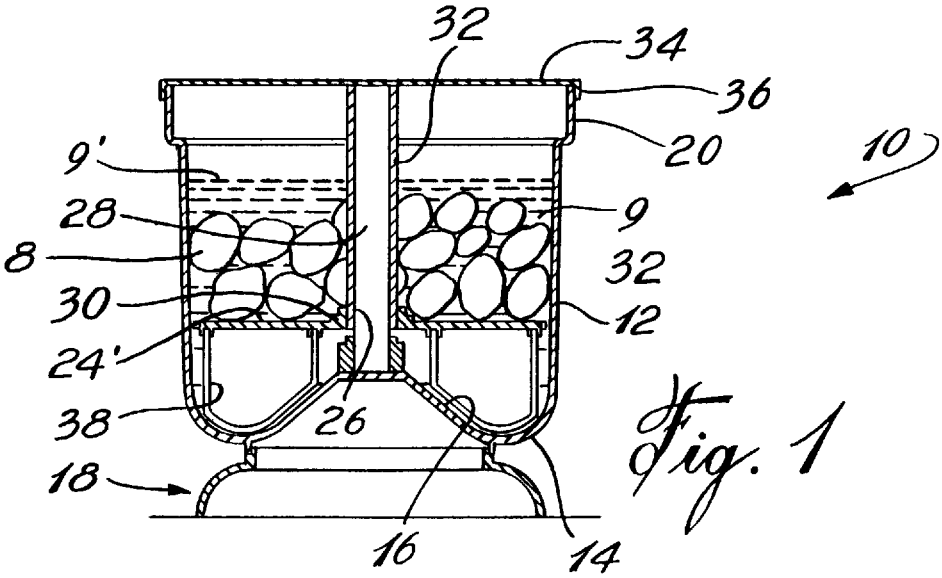
FIG. 1 is a cross-section view illustrating a container fabricated in accordance with a first embodiment of the present invention with its inner support base in a lowermost position.

Referring to FIG. 1, there is shown a container 10 constructed in accordance with a first embodiment of the present invention. The container 10 has an outer shell defining a peripheral wall 12 extending integrally into base wall 14. As hereinshown, the base wall 14 has a cavitated base of generally "W"-shaped cross-sectional configuration defining a raised central section 16. The container 10 also preferably has a stabilizing base 18 extending integrally from the outer base wall 16. The stabilizing base 18 could optionally be detachable. The peripheral wall 12 defines an open top end 7 and an upper spacing lip 20 is radially spaced from the peripheral wall 12 by a radial spacing segment 46. The spacing lip 20, in turn, defines an upper peripheral edge thereof referred to by the reference numeral 22.

One of the main features of the present invention resides in the presence of a height adjustable inner support base 24. The inner support base 24 may have a dripping means for allowing liquid to drip thereunderneath. The dripping means preferably takes the form of at least one and preferably a plurality of drainage apertures (not shown) extending therethrough. The drainage apertures are configured and sized so as to allow through flow of a liquid while preventing the flow of solid objects contained in the container 10. Alternatively, the dripping means could take the form of a peripheral spacing 6 between the outer peripheral edge of the inner support base 24 and the peripheral wall 12, the spacing 6 allowing through flow of a liquid as indicated by arrow A in FIG. 2. The top support surface 24' of the base 24 may be flat or sloped.

Preferably, the inner support base 24 has a guiding aperture 26 extending centrally therethrough. A hollow guiding tube 32 extends upwardly from the top surface 24' of the inner support base 24. In the preferred embodiment, the container 10 also includes a guide post 28 extending substantially upwardly from the center outer base wall 14, as shown in the drawings.

The guiding aperture 26, the guide tube 32 and the guiding post 28 are adapted to cooperate for guiding the movement of the inner support base 24 inside the container 10. The guiding aperture 26 and the guide tube 32 are thus configured and sized so as to fittingly receive the guiding post 28 while allowing a sliding relative motion between the components. A reinforcement rim 30 preferably extends from the peripheral edge of the guiding aperture 26 to stabilize the tube 32. The post 28 may be replaced by one or more vertical guide ribs formed in the inner face of the container and one or more grooves formed in the periphery of the support base. The guide tube 32 would remain to urge the support base into the liquid and to serve as a finger gripping means.

A lid 34 is provided for closing the open-top container 10. The lid 34 is provided with a perpendicularly depending circumferential flange 36 for frictionally engaging the outer surface of the lip 20.

A biasing means is provided for biasing the inner support base 24 upwardly towards the open top end. In the first embodiment illustrated in FIGS. 1 and 2, the biasing means takes the form of a hollow floatation chamber 38 extending integrally from the lower surface of the inner support base 24. In use, the inner support base 24 is releasably maintained in a lowermost and immersed position, illustrated in FIG. 1 by the abutting contact of the upper section of the post 32 on the lid 34 when the latter closes the container 10 and is frictionally engaged about the peripheral edge 22 of the side wall 12 with a force sufficient to overcome the pushing force of the support base 24 tending to float in the liquid 9.

Figure 2:
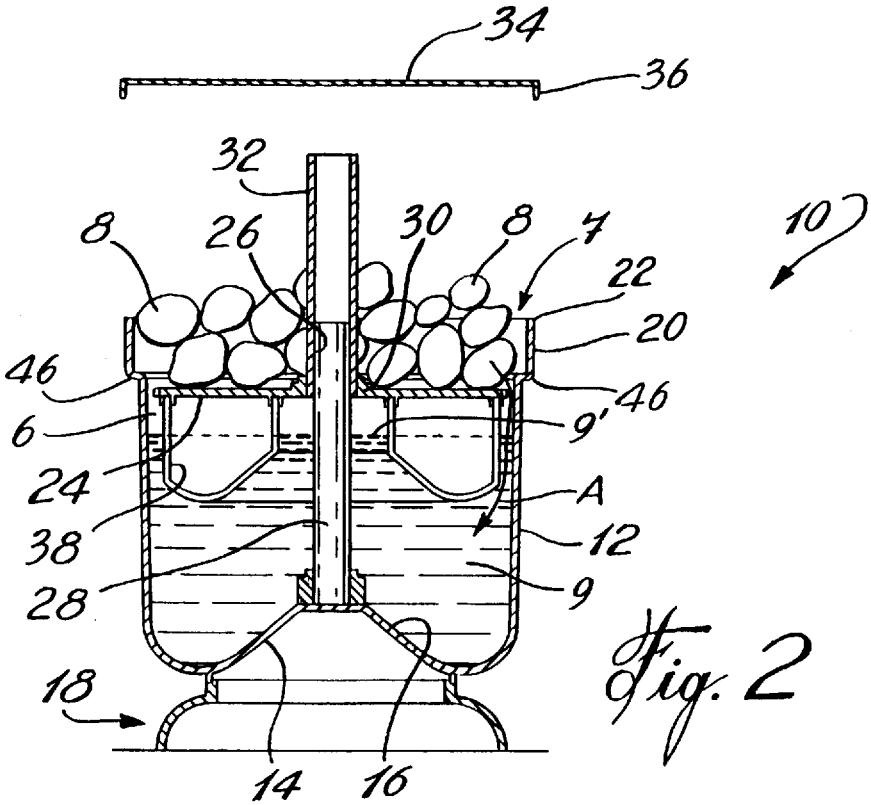
FIG. 2 is a cross-section view illustrating the same container but with the support base in an uppermost position and the lid shown removed.

Once the lid 34 is removed, as illustrated in FIG. 2, the buoyancy of the floating chamber 38 pushes the latter upwardly while the liquid is drained through the drainage apertures and the objects 8 are brought in the vicinity of the lip 20 thus facilitating access thereto. Of course, as the objects 8 are removed there is less load on the support base 24 and it will rise higher towards the top surface 9' of the liquid 9. The floatation chamber 38 may also be formed by a solid floatation foam material.

Figure 3:
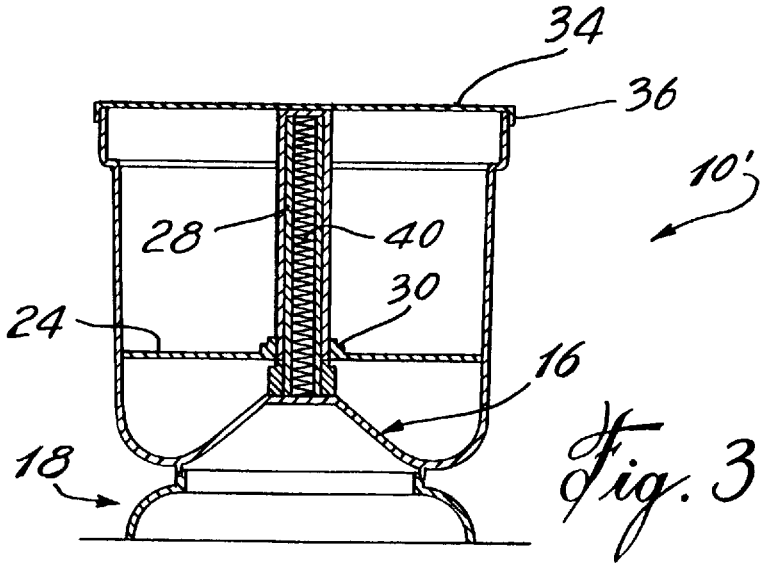
FIG. 3 is a cross-section view illustrating a container fabricated in accordance with a second embodiment of the present invention with its inner support base in a lowermost position.
Figure 4:
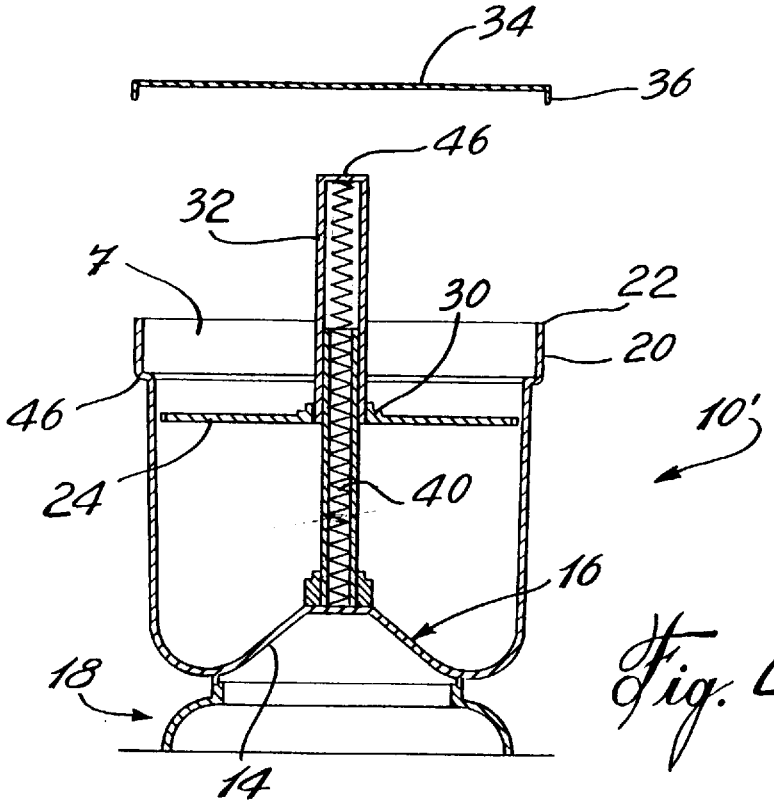
FIG. 4 is a cross-section view illustrating the container of FIG. 3 with its inner support base in an uppermost position and the lid shown removed.

FIGS. 3 and 4 illustrate a second embodiment of the invention 10' wherein similar reference numerals are used to designate similar components. Instead of a floatation chamber, the second embodiment uses a helicoidal type spring 40 as a biasing means for biasing the inner bottom wall 24 upwardly. The longitudinal ends of the spring 40 abuttingly contact respectively the outer support base 14 and an inner surface of a top wall 46 of the hollow tube 32.

Figure 5:
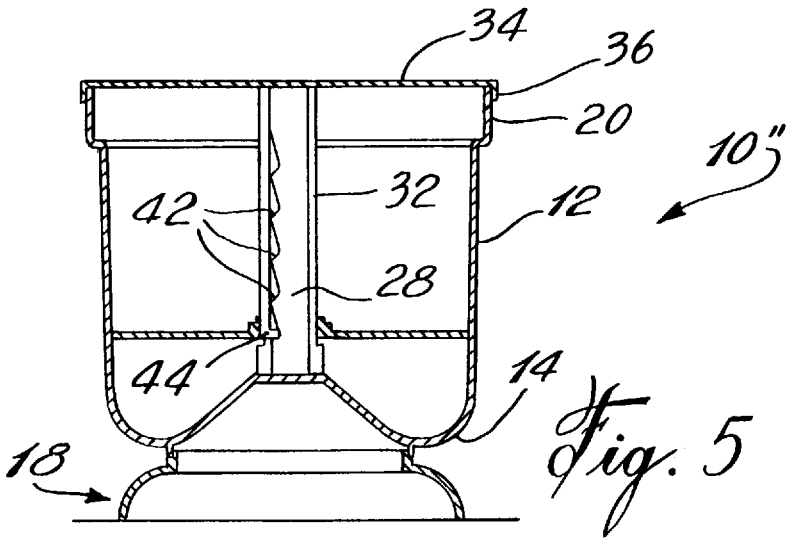
FIG. 5 is a cross-section view illustrating a container in accordance with a further embodiment of the present invention with its inner base wall in a lowermost position.
Figure 6:
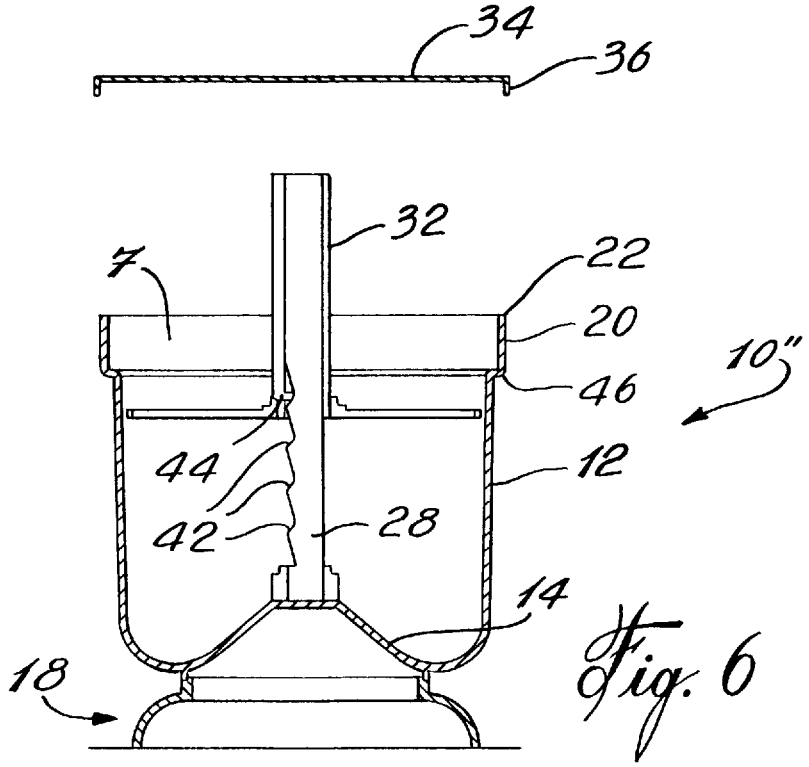
FIG. 6 is a cross-section view illustrating the container of FIG. 5 with its inner support base in an uppermost position.

FIGS. 5 and 6 illustrate yet a third embodiment 10" of the invention wherein the biasing means is replaced with an indexed locking system allowing the inner base wall 24 to be releasably locked at various predetermined locations relative to the lip 20 after having been manually pulled upwardly.

The locking system preferably includes a set of angled notches 42 formed on the post 28 and a flexible locking tongue 44 formed integrally in the wall of the plate guiding tube 32. The tongue 44 being adapted to cooperate with the notches 42 for releasably locking the inner support wall 24 at a predetermined height. The tongue 44 is preferably resilient thus allowing for an automatic indexing action as the inner support wall 24 is raised.

As mentioned previously, another feature of the invention is that it is specifically configured so as to be integrally manufactured using conventional methods such as injection molding using polymeric resins.

It is within the ambit of the present invention to cover any obvious modifications of the embodiments described herein, provided such modifications fall within the scope of the appended claims.

I claim:

1. A container comprising a circumferential sidewall having an integral base wall for support of said container, said container having an open top end, said circumferential side wall having a peripheral top edge, an article support base displaceable in said container, guide means for guiding said support base, floatation means for urging said support base in an upward direction towards said open top end to expose one or more objects placed on said support base and immersed in a liquid placed within said container, a lid to close said open top end and to engage a projecting means connected to said support base to push and maintain said support base into said liquid when contained in said container, and passage means for displacement of liquid from opposed top and bottom ends of said support base.

2. A container as claimed in claim 1 wherein said floatation means is a hollow chamber formed in said support base.

3. A container as claimed in claim 2 wherein said integral base wall has a raised central section, said article support base having a cavitated base adapted to rest in a guided manner on said raised central section.

4. A container as claimed in claim 3 wherein said container is a cylindrical container of circular cross-section, said article support base being formed as a circular disc.

5. A container as claimed in claim 1 wherein said one or more articles are foodstuff articles immersible in a preservative-type liquid.

6. A container as claimed in claim 1 wherein said guide means is constituted by a guide post secured centrally to said base wall of said container and projecting vertically upwards in said container, and an aperture means in said article support base for receiving said guide post therein.

7. A container as claimed in claim 6 wherein said aperture means is constituted by an elongated straight vertical hollow tubular member extending from a top wall of said article support base, said guide post being received in sliding fit within said hollow tubular member, said tubular member constituting said projecting means.

8. A container as claimed in claim 1 wherein said projecting means is a vertical post secured to said article support base and projecting upwardly and centrally of said article support base a predetermined distance.

9. A container as claimed in claim 8 wherein said vertical post also constitutes a finger grasping post to retract said support base from said container.

10. A container as claimed in claim 1 wherein said passage means is formed by a radial spacing between an outer peripheral edge of said article support base and an inner surface of said circumferential sidewall of said container.

11. A container as claimed in claim 1 wherein said lid is provided with a circumferential depending flange for tight frictional engagement about said peripheral top edge, said top edge being provided about an upper spacing lip of said sidewall of said container.

* * * * *

UNITED STATES PATENT AND TRADEMARK OFFICE

CERTIFICATE OF CORRECTION

PATENT NO. : 5,868,266
DATED : February 9, 1999
INVENTOR(S) : JAMSHID NOBAKHT

It is certified that error appears in the above-identified patent and that said Letters Patent is hereby corrected as shown below:

On the title page, insert item [30]:

| | | |
|---|---|---|
| **Sep. 26,1996** | **[GB]** | **Great Britain.....961769** |
| **Aug. 14,1997** | **[CA]** | **Canada .....2,213,107** |

Signed and Sealed this

Twentieth Day of July, 1999

*Attest:*

*Attesting Officer*

Q. TODD DICKINSON

*Acting Commissioner of Patents and Trademarks*